US005947628A

United States Patent [19]

Hansen

[11] Patent Number: 5,947,628

[45] Date of Patent: Sep. 7, 1999

[54] TABLE-TOP CONNECTOR

[75] Inventor: Jesper Moller Hansen, Copenhagen, Denmark

[73] Assignee: Siso A/S, Virum, Denmark

[21] Appl. No.: 08/945,979

[22] PCT Filed: May 15, 1996

[86] PCT No.: PCT/DK96/00214

§ 371 Date: Dec. 11, 1997

§ 102(e) Date: Dec. 11, 1997

[87] PCT Pub. No.: WO96/36252

PCT Pub. Date: Nov. 21, 1996

[30] Foreign Application Priority Data

May 19, 1995 [DK] Denmark ..... 0576/95

[51] Int. Cl.[6] ..... F16B 2/02

[52] U.S. Cl. ..... 403/329; 403/326; 108/64; 108/65; 24/588; 24/625

[58] Field of Search ..... 403/329, 293, 403/388, 326; 52/582.1, 582.2; 108/64, 69, 90, 65, 83, 89; 24/588, 682.1, 625; 312/111

[56] References Cited

U.S. PATENT DOCUMENTS

| | | | |
|---|---|---|---|
| 477,819 | 6/1892 | Pforr | 24/625 X |
| 952,408 | 3/1910 | Baugh . | |
| 2,096,319 | 10/1937 | Churchill | 24/625 X |
| 2,099,655 | 11/1937 | MacFadden | 24/625 X |
| 2,723,171 | 11/1955 | Carder . | |
| 3,515,077 | 6/1970 | Glowacki | 108/89 |
| 3,915,100 | 10/1975 | Sullivan | 108/64 |
| 4,064,814 | 12/1977 | Pokorny et al. . | |
| 4,266,882 | 5/1981 | Wilhelmi et al. | 108/83 X |
| 5,182,996 | 2/1993 | Gutgsell | 108/64 |
| 5,438,937 | 8/1995 | Ball et al. | 108/64 |
| 5,560,302 | 10/1996 | Diffrient et al. | 108/64 |
| 5,678,948 | 10/1997 | White | 108/64 X |

FOREIGN PATENT DOCUMENTS

| | | |
|---|---|---|
| 24 02 525 | 7/1975 | Germany . |
| 2100121 | 12/1982 | United Kingdom . |

*Primary Examiner*—Janet M. Wilkens
*Attorney, Agent, or Firm*—Larson & Taylor

[57] ABSTRACT

Two table tops or table-top parts (2,3) are releasably interconnected by a female part (6), with the associated table-top part (3) forming a channel at right angles to the edge (5), and a male part (11) with a bifurcated, elastically resilient coupling member adapted to be in engagement with the channel, the male part being releasably held in the connecting position by protruding ears (17) cooperating with the rear (right-side) side of the female part (6), the male part (11) being rotatably (at 12) secured to an anchor member (10) rigidly secured by screws (8) to the other table top or table-top part (2), so that in an inactive, disengaged position (not shown), the male part (11) can be rotated about a pivot (12) out of sight.

6 Claims, 2 Drawing Sheets

TABLE-TOP CONNECTOR

TECHNICAL FIELD

The present invention relates to a connector for table tops or table-top parts, as well as the use of such connectors.

BACKGROUND ART

When arranging tables in rooms or halls for meetings, assemblies or parties, it is frequently necessary to be able to arrange the tables in different ways, e.g. in successive rows, in "horseshoe shape", in an open rectangle or in a manner adapted to the wall limits of said room or hall, and in order to avoid that the individual tables in the arrangements come out of position, it may be desirable to connect or couple adjacent edges of the table tops to each other. Likewise, it is often desirable to be able to use insert table tops between the individual independent tables in such an arrangement, partly to avoid the inconvenience otherwise occurring that some participants are placed facing two closely adjacent table legs, partly because in this manner, it is possible using a smaller number of independent tables to achieve a table arrangement with a greater length and also, depending on the shape of certain of the insert table tops, to achieve a more appropriate and varied shape of the table arrangement. Obviously, to achieve this, it is necessary to be able to interconnect the edges of the tops of independent tables with the edges of the insert table tops placed between them.

Connectors having been used up to the present for interconnecting independent tables or connecting table tops on independent tables with insert table tops between them are frequently large and clumsy and have to be assembled manually from the lower side of the table using the fingers or special tools. To this must be added that, when the independent tables are not connected to each other or to insert table tops but used singly, the previously known connectors are highly visible and give the table an unpleasant "technical" appearance.

DISCLOSURE OF THE INVENTION

It is the object of the present invention to provide a connector for releasably interconnecting a table top or a table-top part with another table top or table-top part edge-to-edge, said connector comprising a first connector element to be secured below an edge of the first-mentioned table top or table-top part, and a second connector element adapted to cooperate with said first connector element and to be secured below an edge of said other table top or table-top part that

- does not exhibit the disadvantages referred to above,
- is simple in construction with very small dimensions,
- does not require manual assembly work, but
- with which both the operation of connecting and the operation of disconnecting the table tops or table-top parts to each other or from each other, respectively, occurs so to speak automatically and practically without any effort, and
- is quite invisible when the tables are used singly.

At the same time, the connector according to the present invention should be capable of being manufactured easily and in a low-cost manner from commercially currently available sheet-metal material by means of simple and well-known shaping and machine methods.

This object is achieved according to the invention with a connector of the kind referred to, which is characterized in that an elongate coupling member with substantially the same cross-sectional shape as the channel formed by said first connector element, said member comprising an offset step and being rotatable relative to said anchor member between an engagement position, in which position its longitudinal axis substantially coincides with the central axis of said channel in said first connector element to be connected to said first-mentioned table top or table-top part, and an inactive position, in which said coupling member is completely covered by said other table top or table-top part that it is intended to be connected to that said coupling member is elastically compressible, at least at its end adapted to engage with said first connector element and that said coupling member comprises locking means for releasable locking engagement with said first connector element to be connected to said first-mentioned table top or table-top part.

It is another object of this invention to provide a connector in which the connector elements are guided into mutual engagement in an easy and unproblematic manner during the connecting operation.

It is another object of the invention to provide a connector with an elastic compressibile coupling member.

According to a further object of the invention the coupling member can be releasably locked. On the one hand, this makes it easier to guide it into the channel formed by the first connector element during the connecting operation, and on the other hand it ensures that this member remains invisible in its inactive position.

BRIEF DESCRIPTION OF THE DRAWINGS

In the following detailed portion of the present description, the invention will be explained in more detail with reference to the exemplary embodiment of a table-top connector according to the invention shown in the drawings, in which.

DESCRIPTION OF THE PREFERRED EMBODIMENT

Figure 1A:
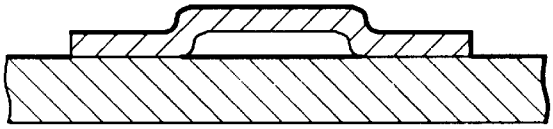
FIG. 1 is a bottom view showing the parts of two table tops or table-top parts interconnected by means of a connector according to the invention, FIG. 1(*a*) is a cross section taken along the line A—A' in FIG. 1.
Figure 1:
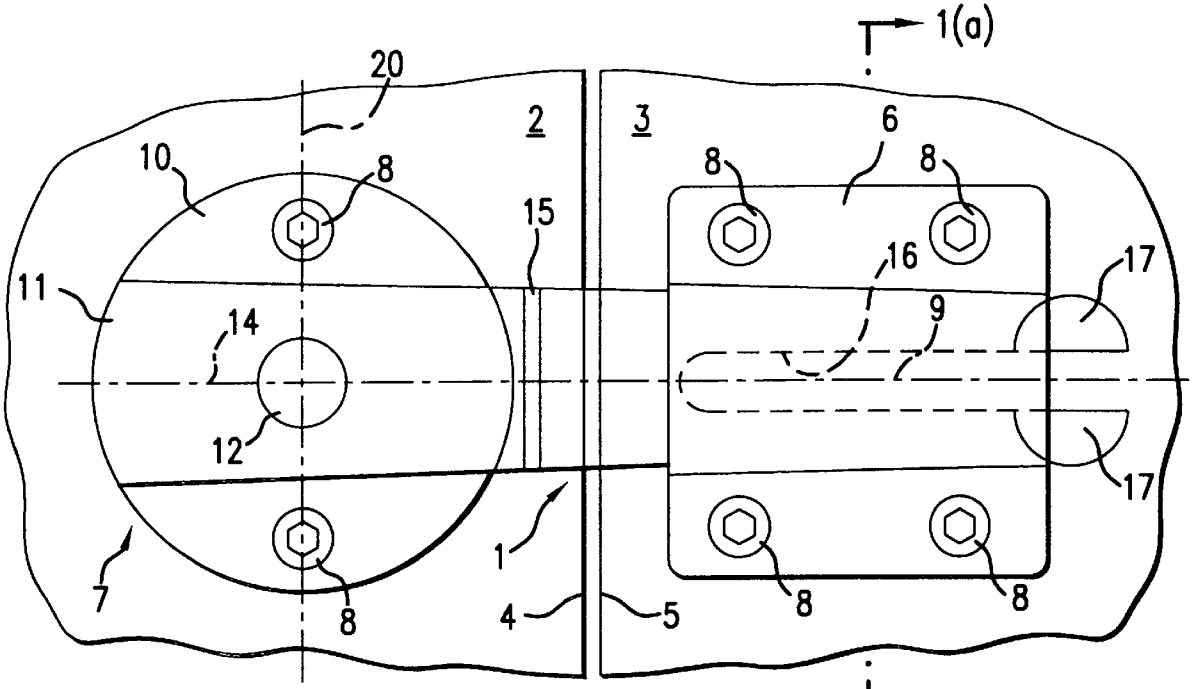
Figure 2:
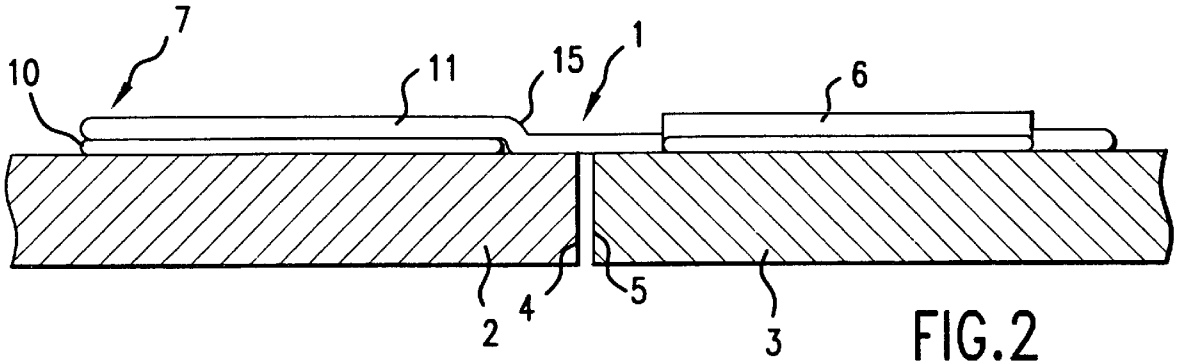
FIG. 2 shows the same as FIG. 1 in a side view, partly in section.

FIGS. 1 and 2 show a connector generally designated 1, adapted to connect in a releasable manner two table tops or a table top and a table-top leaf 2 and 3, respectively, at their end edges 4 and 5, respectively.

The connector 1 consists of a first connector element 6 secured to the lower side of the leaf 3, and a second connector element generally designated 7 secured to the lower side of the table top 2. As shown in FIG. 1, the connector elements 6 and 7 are secured to the table top 2 and the leaf 3, respectively, by means of countersunk cross-head screws 8.

The first connector element 6 consists of a square metal plate bent or embossed so as to have a U-shaped recess along its central part, said recess together with the leaf 3 forming a channel with a substantially flat, rectangular cross-sectional shape, the cross-section being perpendicular to the central axis 9 of which extends substantially at right angles to the end edge 5, said channel having a constant height and diverging in a wedge-like manner towards the end edge 5. The second connector element 7 consists of a circular anchor plate 10 secured to the lower side of the table top or auxiliary table top 2 by means of four countersunk cross-head screws 8, of which only two can be seen in FIG. 1, and of an elongate coupling fork 11. The screws have screwdriver recesses that are cruciform or hexagonal. The coupling fork 11 is rotatably secured to the anchor plate 10, e.g. by means of a pivot stud, such as a rivet 12 being secured centrally in the anchor plate 10 and extending with a slide fit through a chamfered bore 13 (see FIGS. 3 and 4) centered on the central axis 14 of the coupling fork 11. Further, the coupling fork 11 comprises an offset step 15 outside of the periphery of the anchor plate 10, so that its surface being uppermost in the operating position (lowermost in FIG. 2) lies in substantially the same plane as the lower side of the table top 2. The coupling fork 11 is wedge-shaped along substantially its full length with the same wedge angle as the channel formed between the first connector element 6 and the leaf 3 and—to the extent to which its outer end engages said channel—substantially the same external dimensions as the internal dimensions of the channel.

Figure 3:
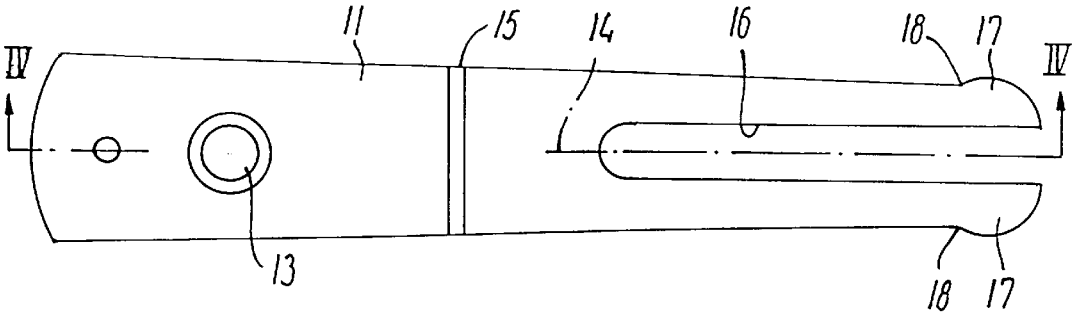
FIG. 3 is a plan view of the coupling member of the second connector element.
Figure 4:
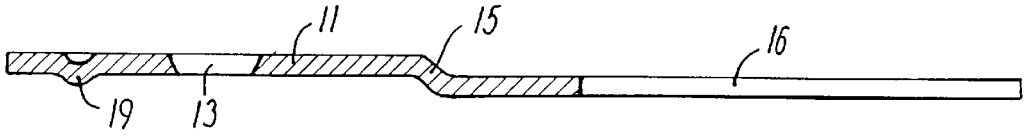
FIG. 4 is a section along the line IV—IV in FIG. 3, and FIGS. 5*a*, 5*b* and 5*c* diagrammatically illustrate three stages in the operation of interconnecting the connector elements according to the invention.

As shown in FIGS. 3 and 4, the outer end of the coupling fork 11 is slotted to form a slot 16 along substantially that part of its length engaging the channel in the first connector element 6, and the tips of the prongs of the coupling fork 11, in the operating position shown in FIG. 1 protruding behind the first connector element, are in the shape of circle segments 17 protruding laterally from the coupling fork 11, the innermost ends of the circle segments 17 with the lateral edges of the prongs forming shoulders 18 adapted for locking abutment against the rearmost lateral edges of the channel in the first connector element 6.

As shown in FIG. 4, the other end of the coupling fork 11 comprises a projection 19 facing toward the anchor plate 10, said projection lying at the same distance from the pivot stud 12 or the bore 13 as the center point of the four symmetrically situated screws 8, of which the two that may be seen in FIG. 1 lie on a line 20 parallel to the end edge 4 of the table top 2. The function of the projection 19 is to engage with the screwdriver recesses in the screws 8 so as to lock releasably the coupling fork 11 in position, in which its longitudinal axis 14 is either, as shown in FIG. 1 substantially at right angles to the end edge 4 of the table top 2, or substantially parallel to said end edge 4.

The connector 1 having been described can be manufactured from sheet-metal material, e.g. stainless steel sheet, in a simple and low-cost manner by using simple and uncomplicated shaping and machining methods, such as punching, embossing, boring and rivetting, and likewise, its connector elements 6 and 7 can easily and readily be secured to the lower sides of table tops and table-top leaves, respectively. When made from sheet metal 3 mm thick, the height of the connector elements 6 and 7 will be approximately 6 mm, and when secured to the lower side of a table top 2 or 3 as shown in FIG. 1 with the coupling fork 11 in the inactive position, they cannot be seen by a person passing the table or taking a seat or sitting at the table.

Figure 5:
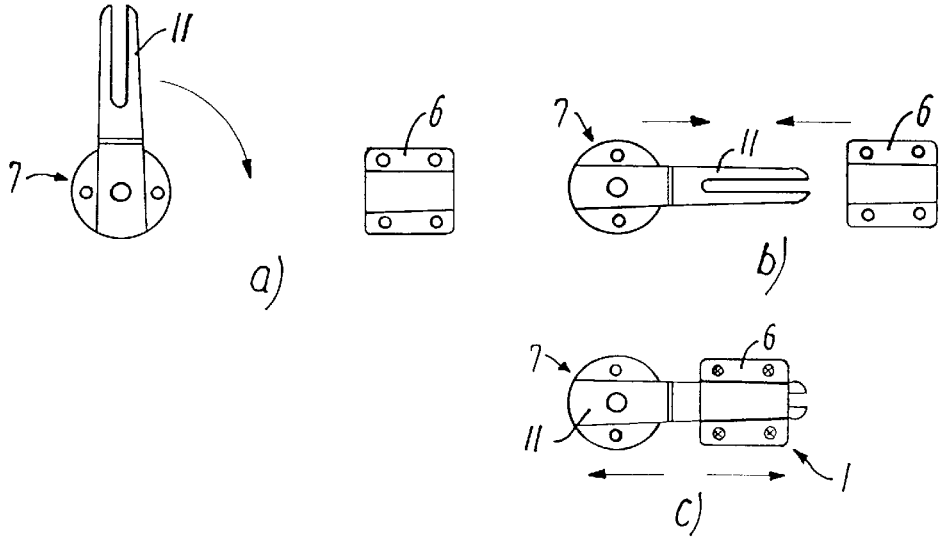

FIGS. 5*a, b* and *c* illustrate in a purely diagrammatic manner the mode of operation of a connector according to the invention, the associated table tops or table-top leaves not being shown in the figure illustrating the various stages of the coupling operation as viewed from below.

FIG. 5*a* illustrates a situation, in which the coupling fork 11 belonging to the second connector element 7 is releasably locked in a position, in which its longitudinal axis is parallel with the end edge of the associated table top (not shown), e.g. in FIG. 1 with the edge 4 of the table top 2, the projection 19 (FIG. 4) in this position engaging with the screwdriver recess in the right screw 8 in FIG. 1. In this position, the second connector element 7 is completely covered by the associated table top (not shown), and is accordingly invisible as mentioned above. The first connector element 6 is secured to the lower side of the other of the two table tops (not shown) to be connected, and is shown oppositely facing the second connector element 7.

When turning the coupling fork 11 in the direction of the arrow in FIG. 5*a,* so that the projection 19 comes into engagement with the screwdriver recess in the screw shown lowermost in FIG. 1, the situation shown in FIG. 5*b* will arise, in which the coupling fork 11 is situated axially opposite to the channel in the first connector element 6, and when moving the table-top parts associated with the connector element 6 and 7 towards each other in the directions indicated with arrows in FIG. 5*b,* during which the prongs on each side of the slot 16 will first be pressed together elastically, until the circle segments 17 (FIG. 3) have been moved all the way through the channel in the first connector element 6 and the shoulders 18 on these prongs come into locking abutment against the rearmost lateral edges of the channel in the first connector element 6. To move the table-top parts together in this manner requires only a small effort, and it is obvious that the two parts may also—and as a rule will also—be moved together by moving solely one of the two table-top parts (not shown) in the appropriate direction as shown by the associated arrow.

In this manner, the situation shown in FIG. 5*c* will arise, in which the two table-top parts (not shown) have been connected to each other by means of the connector 1 and secured to each other by the locking abutment of the shoulders 18 against the lateral edges of the channel in the first connector element 6.

If the table-top parts (not shown) having been interconnected in this manner are to be separated again, this can be achieved by pulling them apart in the directions shown with arrows in FIG. 5*c* or by pulling one of them away from the other in the appropriate direction. This separation can likewise be carried out with a small effort, as the prongs on each side of the slot 16 in the coupling fork 11 merely have to be pressed together elastically by pulling the circle-segment-shaped outer end 17 into and through the channel in the first connector element 6.

When the table tops of two independent tables, i.e. table tops supported on legs, are to be connected with each other, it could, in principle, be sufficient to use a single connector according to the invention, e.g. situated facing the center point of the table-top edges to be interconnected, but both in this case and, obviously, in the case of connecting an edge of the table top of an independent table to the edge of a supported insertable table top, it is preferred to use at least two mutually spaced connectors according to the invention.

In the above detailed description, a preferred embodiment of the connector according to the invention is described, but it will be appreciated that it is possible to modify this connector in various ways within the scope of the appended claims. Thus, it is not strictly necessary that the channel in the first connector element 6 and the coupling fork 11 are wedge-shaped along their full length. If they had a constant rectangular cross-section along their length, the effect would be almost the same. Likewise, the locking means could be arranged differently from the shoulders 18 on the circle segments 17, e.g. in the form of triangular projections protruding laterally from the outer ends of the prongs on the coupling fork 11, said projections interlocking releasably with suitable openings in the sides of the channel in the first connector element 6. The releasable locking of the coupling fork 11 in the various angular positions could also be achieved with other means than those shown and described.

LIST OF PARTS

1 connector
2 table top
3 leaf
4 end edge
5 end edge
6 first connector element
7 second connector element
8 countersunk screws
9 central axis
10 anchor plate
11 coupling fork
12 pivot stud/rivet
13 chamfered bore
14 central axis
15 offset step
16 slot
17 circle segments
18 shoulders
19 projection
20 line

I claim:

1. Connector (1) for releasably interconnecting a table top or a table-top part with another table top or table-top part edge-to-edge, said connector comprising a first connector element (6) to be secured below an edge of the first-mentioned table top or table-top part, and a second connector element (7) adapted to co-operate with said first connector element (6) and to be secured below an edge of said other table top or table-top part, characterized in that said first connector element (6) when secured to said first-mentioned table top or table-top part (3) with the lower side of the latter forms a channel having a substantially flat rectangular cross-sectional shape, the cross section being perpendicular to the central axis (9) of said channel which extends substantially at right angles to the edge (5) of said table top or table-top part (3), that the second connector element (7) consists of two parts, namely a first part being an anchor member (10) to be secured to said other table top or table-top part (2) in such a manner, that in the connecting position, it lies centered on the central axis (9) of the channel in said first connector element (6) to be connected to said first-mentioned table top or table-top part (3), and a second part being an elongate coupling member (11) with substantially the same cross-sectional shape as the channel formed when said first connector element (6) is secured to said first mentioned table top or table-top part, said member (11) comprising an offset step (15) and being rotatable relative to said anchor member (10) between an engagement position, in which position its longitudinal axis (14) substantially coincides with the central axis (9) of said channel in said first connector element (6) to be connected to said first-mentioned table top or table-top part (3), and an inactive position, in which said coupling member (11) is completely covered by said other table top or table-top part (2) that it is intended to be connected to, that said coupling member (11) is elastically compressible, at least at its end adapted to engage with said first connector element (6) and that said coupling member (11) comprises locking means (17, 18) for releasable locking engagement with said first connector element to be connected to said first-mentioned table top or table-top part (3).

2. Connector (1) according to claim 1, characterized in that said channel formed when said first connector element (6) is connected to the lower side of said first-mentioned table top or table-top part (3) has a constant height and is wedge-shaped with the largest cross-section facing the edge (5) of said table top or table-top part (3) to which it is intended to be connected, and that said coupling member (11) at least with its outer end adapted to engage said first connector element (6) is wedge-shaped in a complementary manner.

3. Connector (1) according to claim 1, characterized in that said coupling member (11) comprises an open slot (16) extending at least along the part adapted to engage with said first connector element (6).

4. Connector (1) according to claim 3, characterized in that the coupling member (11) is fork-shaped and thus defines two prongs, the tips of the prongs have the shape of circle segments (17) protruding laterally beyond the coupling member (11) and in the connecting position protruding behind said first connector element (6) and functioning as said locking means (18).

5. Connector (1) according to claim 1, characterized in that said coupling member (11) is adapted to be held releasably in its engagement position (FIGS. 5*b* and 5*c*) and its inactive position (FIG. 5*a*).

6. Connector (1) according to claim 5, characterized in that said anchor member (10) comprises four symmetrically situated countersunk screw holes usable for securing to said other table top or table-top part (2) by means of countersunk screws (8) with cruciform or hexagonal screwdriver recesses, two of said screw holes being centerable on a line (20) parallel to the edge (4) of said other table top or table-top part (2) to which said anchor member is intended to be connected, and that said coupling member (11) is rotatably connected to said anchor member (10) about a pivot stud (12) situated centrally in the latter and in the same radial distance as said countersunk screw holes from said pivot stud (12) has a projection (19) facing said anchor member (10) for releasable locking engagement with said cruciform or hexagonal screwdriver recesses.

* * * * *